US005973606A

United States Patent [19]

Maitin et al.

[11] Patent Number: 5,973,606

[45] Date of Patent: Oct. 26, 1999

[54] ACTIVATION/DEACTIVATION SYSTEM AND METHOD FOR ELECTRONIC ARTICLE SURVEILLANCE MARKERS FOR USE ON A CONVEYOR

[75] Inventors: Steve R. Maitin, Lake Worth; Ron Easter, Parkland, both of Fla.

[73] Assignee: Sensormatic Electronics Corporation, Boca Raton, Fla.

[21] Appl. No.: 08/986,597

[22] Filed: Dec. 8, 1997

[51] Int. Cl.[6] ..... G08B 21/00

[52] U.S. Cl. ..... 340/676; 340/551; 340/572.1; 340/573.3; 361/143

[58] Field of Search ..... 340/676, 551, 340/572, 825.31, 825.32, 825.33, 825.34, 825.54; 361/143, 149

[56] References Cited

U.S. PATENT DOCUMENTS

| | | | |
|---|---|---|---|
| 3,832,530 | 8/1974 | Reitboeck et al. | 340/551 |
| 3,899,071 | 8/1975 | Duffy | 340/676 |
| 4,498,076 | 2/1985 | Lichtblau | 340/572 |
| 4,510,489 | 4/1985 | Anderson, III et al. | 340/572 |
| 4,623,877 | 11/1986 | Buckens | 340/572 |
| 4,728,938 | 3/1988 | Kaltner | 340/572 |
| 4,792,018 | 12/1988 | Humble et al. | 186/61 |
| 5,008,649 | 4/1991 | Klein | 340/572 |
| 5,059,951 | 10/1991 | Kaltner | 340/572 |
| 5,081,445 | 1/1992 | Gill et al. | 340/572.1 |
| 5,121,103 | 6/1992 | Minasy et al | 340/551 |
| 5,126,720 | 6/1992 | Zhou et al. | 340/572 |
| 5,204,526 | 4/1993 | Yamashita et al. | 235/493 |
| 5,341,125 | 8/1994 | Plonsky et al. | 340/572 |
| 5,410,296 | 4/1995 | Montbriand et al. | 340/572 |
| 5,463,376 | 10/1995 | Stoffer | 340/572 |
| 5,495,230 | 2/1996 | Lian | 340/551 |
| 5,680,106 | 10/1997 | Schrott et al. | 340/572 |

*Primary Examiner*—Daniel J. Wu
*Assistant Examiner*—Toan Pham
*Attorney, Agent, or Firm*—Rick F. Comoglio, Esq.; Paul T. Kashimba, Esq.

[57] ABSTRACT

A system and method for setting the activation state of electronic article surveillance markers, tags, and labels being transported on a conveyor system is provided. The system includes a pair of electromagnetic transmitting coils mountable on opposite sides of a conventional conveyor section, an electronic controller, and can include a remote external controller for manual operation. The electromagnetic transmitting coils are mounted within sensor housings that include one or more sensors to automatically sense an article traveling on the conveyor system and trigger the transmission of preselected activation or deactivation electromagnetic pulses when the article is in the proper location. The system can include an inhibiting sensor input to prevent the automatic transmission of an activation/deactivation pulse for specific preselected articles. The system includes a logic scheme to preselect and shape the activation or deactivation electromagnetic pulse.

30 Claims, 6 Drawing Sheets

ACTIVATION/DEACTIVATION SYSTEM AND METHOD FOR ELECTRONIC ARTICLE SURVEILLANCE MARKERS FOR USE ON A CONVEYOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to activation and deactivation of electronic article surveillance markers, tags, and/or labels used for triggering electronic article surveillance systems. More particularly, the invention relates to selective activation or deactivation of electronic article surveillance markers moving along a conveyor, such as in a manufacturing or distribution environment.

2. Description of Related Art

Inventory shrinkage, or loss of inventory due to theft and pilferage, is a substantial problem in the retail industry. Costs associated with inventory shrinkage can be significant for the retailer, and are often passed along to the consumer resulting in higher prices to the general public. In addition, some businesses may experience a loss of capital equipment due to employee theft. Several technical solutions have been implemented in the retail and other industries to reduce inventory shrinkage and loss of capital equipment. One solution involves attaching a tag, marker, or label (referred to herein as marker) to the retail or other article which, when brought into the vicinity of prepositioned sensors, triggers an electronic article surveillance (EAS) system which alerts store or security personnel.

Electronic article surveillance (EAS) systems and associated markers are known in the art, and encompass several different yet related technologies used to sense the markers that trigger the systems. Active markers typically react to an electromagnetic interrogation signal in a manner that is clearly recognized by the system's receiver(s). The EAS system's transmit and receive sensors are placed in preselected locations, generally at the store's exits to prevent the unauthorized removal of articles.

The EAS markers can be attached to products and articles by conventional methods such as fasteners, adhesives, hang tags and the like. Once an active marker is attached to an article, when the article passes through the EAS sensors near the business or retail store's exit, the marker is immediately identified by the EAS system. When an active EAS marker is identified by the EAS system, store or security personnel can be automatically alerted, normally by sounding an audible alarm signal.

In a retail environment, if the article is being purchased, the cashier removes, or deactivates the marker. Deactivated markers are not identified by the EAS system when brought into the vicinity of the EAS sensors. Thus, when carried out of the store, purchased articles having attached deactivated markers will not trigger the EAS system.

One example of a particularly well suited marker for use in electronic article surveillance systems as described above is the magnetomechanical marker disclosed in U.S. Pat. No. 4,510,489, issued to Philip M. Anderson, III et al. (the '489 patent), the disclosure of which is incorporated herein by reference.

The marker of the '489 patent produces a specific signal characteristic when exposed to a magnetic field. The marker is adapted to resonate mechanically at a frequency within the range of the incident magnetic field. The marker includes a magnetostrictive material and ferromagnetic element that are positioned adjacent each other such that, when the ferromagnetic element is magnetized, the magnetostrictive material is biased to resonate at a specific frequency. When the ferromagnetic material of the marker is magnetized, the marker is said to be armed or activated. When an armed marker is placed in the magnetic field generated by the EAS system's interrogation sensor(s) it resonates at the expected frequency and is identified by the system's receive sensor(s) as disclosed in the '489 patent.

The markers of the '489 patent are activated by magnetizing the ferromagnetic elements of the markers by exposing the markers to a magnetization field. The magnetization field can be a DC generated magnetic pulse. Deactivation is accomplished by demagnetization of the ferromagnetic elements by exposure to a degaussing field or exposure to a magnetic field that changes the magnetic bias such that the resonant frequency of the marker is shifted outside the range of the interrogation magnetic field and the receive sensors.

Other EAS systems use markers that include tunable electronic circuits such as those disclosed in U.S. Pat. No. 5,608,379 issued to Narlow et al., and as disclosed in U.S. Pat. No. 5,059,951 issued to Kaltner.

Typically, active markers are shipped to the retailer and attached to articles at the point-of-sale in the retail environment in conventional manner as discussed herein above. A deactivation system is available to retail cashiers so markers can be deactivated upon purchase of the attached article.

More recently, attaching markers to articles at the point-of-manufacturing or distribution has been introduced as a desirable alternative to point-of-sale attachment. In point-of-manufacturing, commonly called "source tagging", markers are attached to articles during the assembly or packaging process before being shipped to the ultimate retail business establishment. Alternately, source tagging can include activation or deactivation of markers at distribution centers.

In source tagging, the manufacturer or distributer may attach an active marker on all products assembled or packaged in an automated assembly line. However, the manufacturer, or distributer, may not want all the products to be shipped with an active marker attached. For example, the manufacturer may sell some of the products to retailers that do not have an EAS system. If the retailer sells the product without deactivating the marker, which was incorporated during manufacturing, that article could be carried to a store having an EAS system and inadvertently alert the EAS alarm.

Therefore, manufacturing and/or distribution facilities desire the ability to selectively activate or deactivate the EAS markers at one location. Manufacturers and distributors also desire to activate or deactivate the markers in an automated assembly line to prevent delays and disruption in the flow of products.

In addition, the manufacturer or distributer may sell certain products that could be damaged by electromagnetic activation or deactivation fields. The manufacturer or distributer should be able to control the activation/deactivation system to prevent damage to certain products. Moreover, there exists a need for EAS marker manufacturers to activate markers in bulk, preferably while the markers are being transported along a conveyor system prior to shipment to users.

Conventionally, activation and deactivation of EAS markers has been accomplished by separate devices in separate locations. Normally, marker activation was performed by the marker manufacturer and deactivation by the retailer. Accordingly, source tagging creates the need for selective activation and deactivation in one location by the manufacturer or distributer in a dynamic environment that is adaptable to assembly line or conveyor systems. The instant invention addresses these needs as described herein.

BRIEF SUMMARY OF THE INVENTION

The present invention provides a system and method for setting the activation state of electronic article surveillance markers as they are transported on a conveyor system. The system includes a pair of electromagnetic transmitting coils, an electronic controller, and can include a remote external controller for manual operation.

Each electromagnetic transmitting coil is mounted within a separate sensor housing. The sensor housings are mounted on opposite sides of a conventional conveyor section. In the preferred embodiment, the sensor housings are substantially planar and parallel to each other and are substantially perpendicular to the conveyor surface. The space between the sensor housings, through which articles on the conveyor pass, define an activation/deactivation field area for markers of the type herein described, or equivalents that are activated and deactivated by a preselected electromagnetic field.

The sensor housings are mountable in-line on existing motorized or nonmotorized conveyor sections or on separate standalone conveyor sections. The sensor housings can be mounted at various angles for attachment to inclined conveyors, and can be mounted to ceiling conveyors.

The sensor housings include at least one conventional position indicating sensor, such as a photo sensor, to automatically sense when an article traveling on the conveyor system is within the activation/deactivation field area. When an article triggers the position indicating sensor, a preselected activation or deactivation electromagnetic field is generated within the field area via the electromagnetic transmitting coils.

The size of the sensor housings and field area are preselected according to the electromagnetic field strength required to activate and deactivate the markers. Wide conveyor systems can include attachment of conventional guide rails to guide articles into the activation/deactivation area between the sensor housings.

Connected to each sensor housing is an electronic controller containing the system electronics and power control circuitry used to generate the electromagnetic fields and control transmission by the electromagnetic transmitting coils. The electronic controller provides manual selection of either activation or deactivation electromagnetic fields. The manual selection can be via switch or jumper setting, and is preferably located internal to the electronic controller to prevent the accidental and improper configuration of the system to either activation or deactivation.

In one embodiment, the deactivation electromagnetic field is an electromagnetic pulse that degausses the ferromagnetic element of the marker. The activation electromagnetic field is an electromagnetic pulse which is identical to the deactivation pulse with all but the first portion of the electromagnetic waveform inhibited by control logic. The activation pulse appears as a DC generated magnetic pulse that magnetizes the ferromagnetic element of the marker. As described herein above for one example of a marker, the magnetized ferromagnetic element causes the marker to resonate at a preselected frequency when subjected to the interrogation field of the appropriate electronic article surveillance system sensors.

For automatic operation of the system, articles on the conveyor, passing through the field area, will trigger at least one position indicating sensor located within the sensor housings. When the article on the conveyor system triggers the position indicating sensor, the preselected electromagnetic pulse is transmitted by the electromagnetic transmitting coils to activate or deactivate the markers contained within the activation or deactivation area.

For proper activation or deactivation, markers passing through the activation/deactivation field area are preferably positioned essentially perpendicular to the sensor housings. Therefore, it is preferred that articles moving on the conveyor system be oriented such that EAS markers attached thereto or contained therein will be substantially perpendicular to the sensor housings when the markers are within the activation/deactivation field area. The articles passing on the conveyor can include indicia thereon to indicate proper the orientation of the markers within the field area.

The position indicating sensor is preferably prepositioned within the sensor housings according to the size of article to be sensed, and the direction of the conveyor. Multiple position indicating sensors can be utilized to indicate to the system electronics that, when articles larger or smaller than a preselected size pass into the activation/deactivation field area, the electromagnetic pulses should not be transmitted.

The system electronics further can include an input for at least one additional sensor which provides an inhibit signal that will inhibit or disable the electromagnetic field for a particular article. The sensor can, for example, provide a closed-contact or logic level signal which is sent just prior to a article triggering the position indicating sensors. A closed-contact or other logic level signal can be generated by a plurality of available conventional sensors including photo sensors, manual switches, or bar code or graphic code readers. The closed-contact or logic signal can be used to prevent the electromagnetic pulse from being sent and damaging a particular article that may be sensitive to electromagnetic emissions. The additional sensor can be positioned to sense a particular article just prior to the article reaching the position indicating sensor. In this manner, the system electronics will receive the inhibit signal prior to the signal from the position indicating sensor and inhibit the generation of the activation/deactivation electromagnetic field that would be generated in response to the position indicating sensor signal.

For bar code or graphic code readers, the articles will include bar code or graphic code indicia thereon for reading by a bar code or graphic code sensor positioned such that the inhibit signal will be sent prior to the position indicating signal, as described above.

For manual operation of the system, a remote external controller can be connected to the electronics housing via any conventional method, such as hardwired. The remote external controller includes a control switch to disable the automatic generation of the activation/deactivation electromagnetic fields, and provides a manual switch to generate the fields. The electromagnetic activation or deactivation field can thus be configured to be transmitted only when the manual switch is activated.

Accordingly, it is an objective of the present invention to provide an activator/deactivator for electronic article surveillance markers for setting the activation state of multiple markers being transported on a conveyor system.

It is another objective of the present invention to provide an activator/deactivator for electronic article surveillance markers which is preselectable between activation and deactivation electromagnetic fields.

It is a further objective of the present invention to provide an activator/deactivator for electronic article surveillance markers which is automatically triggered to generate and transmit an activation or deactivation electromagnetic field by articles passing into an activation/deactivation field area.

It is still a further objective of the present invention to provide an activator/deactivator for electronic article surveillance markers that can be manually triggered.

It is yet another objective of the present invention to provide an activator/deactivator for electronic article surveillance markers that includes a sensor input for inhibiting the automatic generation and transmission of the activation and deactivation electromagnetic field.

In accordance with these and other objects which will become apparent hereinafter, the instant invention will now be described with particular reference to the accompanying drawings.

DETAILED DESCRIPTION OF THE INVENTION

Figure 1:
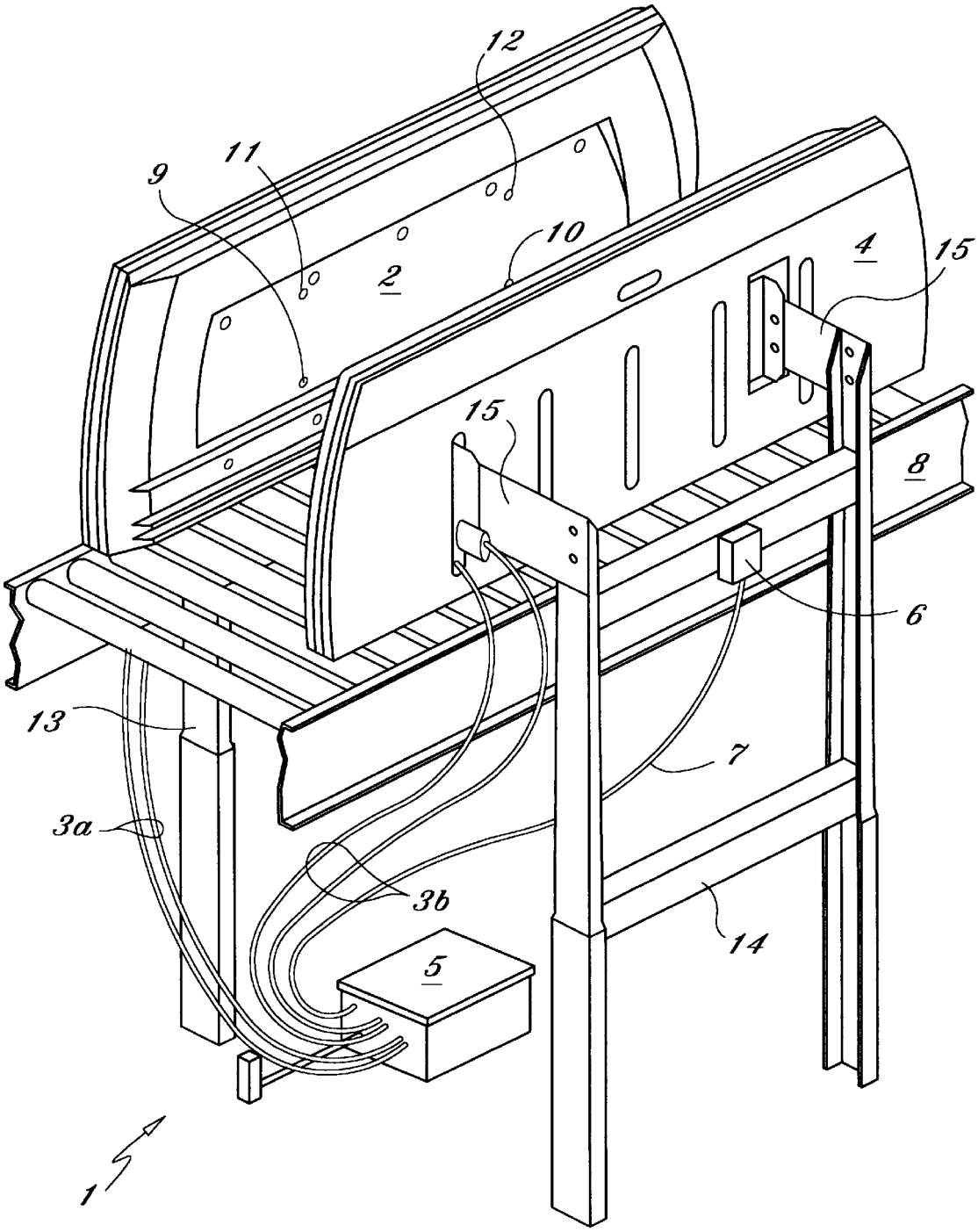
FIG. 1 is a perspective of the preferred embodiment of the invention.

FIG. 1 illustrates the preferred embodiment of the present invention 1 which includes a pair of electromagnetic transmitting coils one mounted in sensor housing 2 and one mounted in sensor housing 4, an electronic controller 5, and a remote external controller 6. Sensor housings 2 and 4 can be electrically connected to electronic controller 5 by suitable electrical cables 3*a* and 3*b*. Remote external controller 6 can be electrically connected to electronic controller 5 by electrical cable 7, or other suitable manner.

Sensor housings 2 and 4 are mounted essentially parallel to each other on opposite sides of a conventional conveyor 8. Conveyor 8 can be any type of conventional conveyor including motorized, nonmotorized, ceiling mounted, inclined, or any equivalent system used to transport articles or products form one point to another particularly in an industrial, manufacturing, or distribution environment. Conveyor 8 can incorporate known devices such as belts, rollers, moving chains or equivalent devices. Conveyor 8 can be an in-line portion of an existing conveyor system, or a separate section added to an existing system as a new activation/deactivation station.

In one embodiment, sensor housings 2 and 4 can be mounted to conveyor 8 by suitable adjustable supports such as 13 and 14. Sensor housings 2 and 4 can be attached to supports 13 and 14, respectively, by suitable adjustable "universal" brackets 15. Supports 13 and 14 and brackets 15 provide for mounting sensor housings 2 and 4 essentially parallel to each other in nearly any configuration of conveyor 8 as described herein above.

Figure 2:
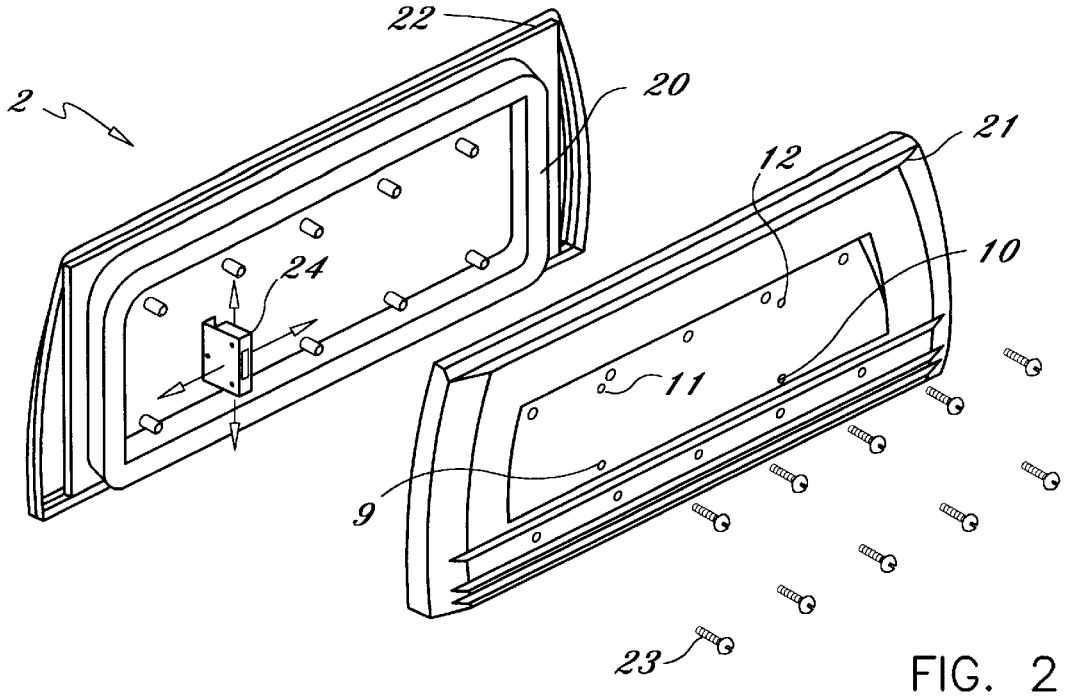
FIG. 2 is an exploded perspective view of one sensor housing of the embodiment of FIG. 1.

Referring to FIG. 2, sensor housing 2 includes electromagnetic transmitting coil 20 surrounded by sensor housing covers 21 and 22. Sensor housing covers 21 and 22 are made of a suitable electromagnetic transparent material, such as plastic, and can be attached together by suitable fasteners 23. Sensor housing 4 is essentially identical to sensor housing 2 and includes a similar electromagnetic coil 20, and similar covers 21 and 22, and is therefore not separately illustrated.

Figure 3:
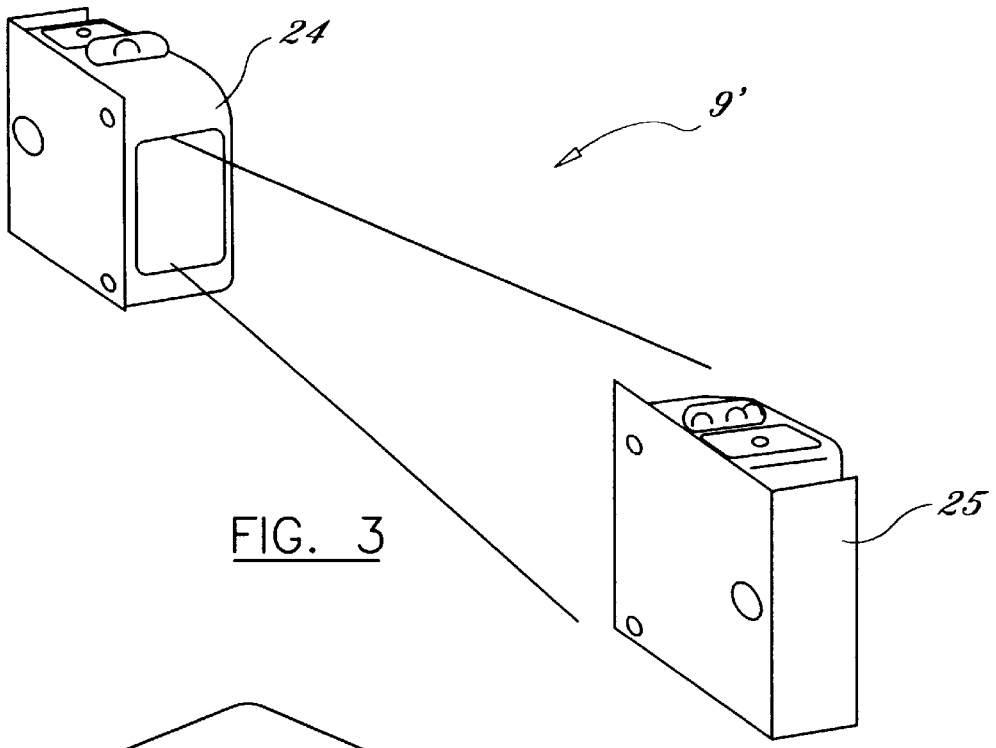
FIG. 3 is a perspective view of one embodiment of the position indicating sensor used in FIG. 1.

Cover 21 includes position indicating sensor apertures 9 and 10 in preselected positions. Referring to FIG. 3, position indicating sensor 9' can be a conventional photo sensor comprising a transmitter 24 and receiver 25. Transmitter 24 is adjustably mounted in sensor housing 2, as shown in FIG. 2. Receiver 25 is adjustably mounted in sensor housing 4 in "mirror image", relationship to transmitter 24 (not shown). Transmitter 24 and receiver 25 are each positioned such that a light beam is transmitted from transmitter 24 in sensor housing 2 to receiver 25 in sensor housing 4 through position indicating aperture 9 and a mating aperture located adjacent receiver 25 in sensor housing 4 (not shown).

Figure 4:
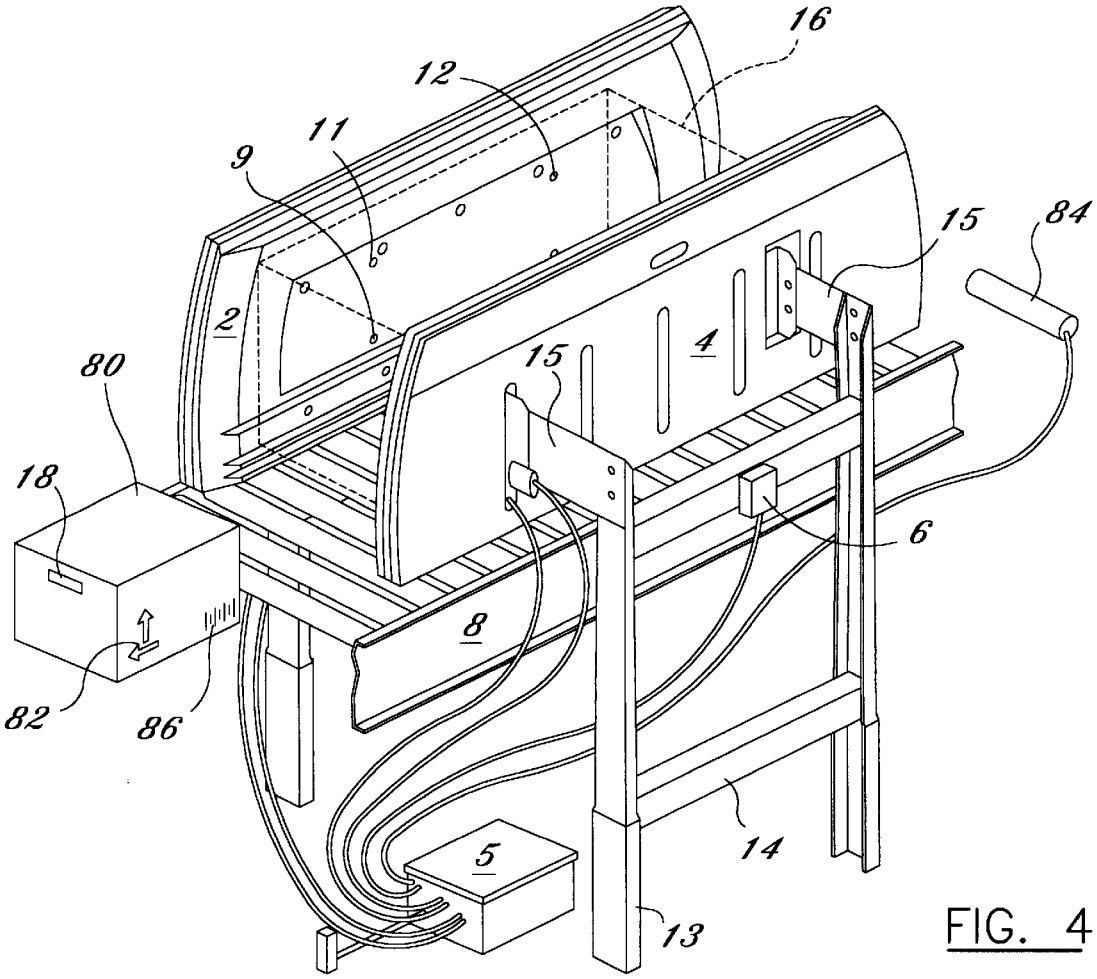
FIG. 4 is a perspective view of the activation/deactivation area of the embodiment of FIG. 1.
Figure 5:
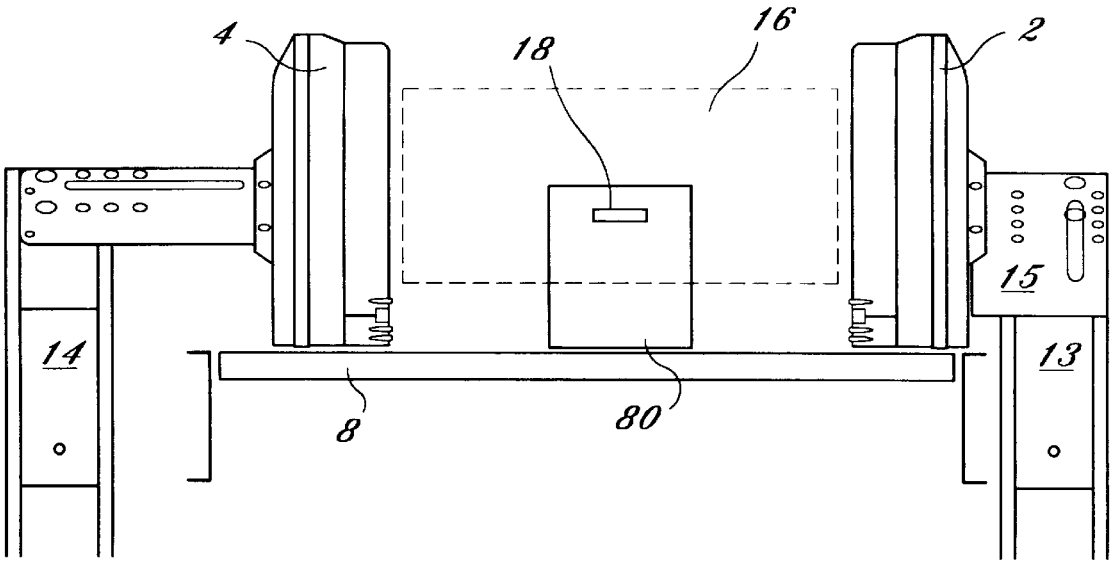
FIG. 5 is a rear elevational view of that shown in FIG. 4.

Position indicating aperture 9 is illustrated in a location suitable for position indicating sensor 9' to sense articles 80, as shown in FIGS. 4–5, passing along conveyor 8 in the direction shown by the arrow in FIG. 1. An alternate location for a position indicating aperture 10 is illustrated for articles 80 passing in a direction opposite that shown by the arrow in FIG. 1.

In addition, position indicating sensor apertures can be positioned in other locations, such as 11 and 12, for sensing articles greater than a preselected size. Position indicating sensors utilized in apertures 11 and 12 can inhibit or enable the transmission of the activation/deactivation electromagnetic field when articles greater than the preselected size are sensed.

The reference to "articles" 80 triggering position indicating sensor 9', and as illustrated by article 80 in FIGS. 4–5, includes one or more packages each containing a plurality of electronic article surveillance system (EAS) markers 18, or one or more packages of products each product having at least one marker 18 attached thereon, or one or more single products each product having at least one marker 18 attached thereto. The term "markers" 18 is used herein to refer to one or more of any type of marker, tag, or label used to trigger electronic article surveillance systems that can be activated and deactivated by exposure to a preselected electromagnetic field.

Referring to FIGS. 4 and 5, for activation, an activation electromagnetic field (as fully described herein below) is generated within the electronic controller 5 and is transmitted by sensor housings 2 and 4 to activation/deactivation field area 16. The activation electromagnetic field is initiated by one or more articles 80 passing along conveyor 8 which trigger position indicating sensor 9'. Position indicating sensor 9' is prepositioned at aperture 9 to trigger the activation electromagnetic field whenever an article 80 is properly positioned within activation/deactivation area 16.

As described above, position indicating sensor 9' can include transmitter 24 and receiver 25, as shown in FIG. 3. A beam of light is transmitted through aperture 9. When articles move along conveyor 8 and break the beam of light passing between transmitter 24 and receiver 25, the activation/deactivation logic generates and transmits the preselected activation electromagnetic field, as fully described herein below. The activation/deactivation logic is contained in controller 5.

Alternately, for manual operation, the preselected activation electromagnetic field is triggered by remote external controller 6 as fully described herein.

The physical size of activation/deactivation field area 16 is determined by the desired preselected size of sensor housings 2 and 4, and the electromagnetic field intensity required to activate the EAS marker 18. For example, the physical size of field area 16 for activation may be approximately fourteen inches (14") wide by twenty four inches (24") long by ten inches (10") deep. The size of field area 16 provides a field strength suitable to activate the type of EAS marker 18 disclosed in the '489 patent as discussed herein above, and in U.S. Pat. No. 5,495,230, the disclosure of which is incorporated herein by reference.

Referring to FIGS. 4 and 5, for deactivation, a deactivation electromagnetic field (as fully described herein below) is generated and transmitted in the same manner as the activation electromagnetic field described above. The physical size of activation/deactivation field area 16 for deactivation, as compared to the activation field size, is approximately eighteen inches (18") wide by twenty four inches (24") long by ten point seventy-five inches (10.75") deep.

It should be noted, however, that the size of activation/deactivation field area 16 may vary without departing from the scope and spirit of the invention.

The electromagnetic fields generated, for both activation and deactivation, between sensor housings 2 and 4 are oriented such that marker 18 is preferably positioned essentially perpendicular to sensor housings 2 and 4 for proper activation and deactivation, respectively. There is no maximum quantity of markers 18 that can be simultaneously activated or deactivated. If a quantity of markers 18 are positioned substantially perpendicular to sensor housings 2 and 4, and the markers 18 are within the activation/deactivation field area 16, then the markers will be activated or deactivated by the corresponding pulse transmitted by sensor housings 2 and 4. Accordingly, the illustration of one marker 18 represents one or more markers, up to the maximum that will physically fit into the activation/deactivation area.

Packaged articles 80 passing along conveyor 8 into the activation/deactivation field area 16 can include aligning indicia 82 thereon to provide a visual indication that the orientation of the attached or enclosed markers 18 are perpendicular to the sensor housings 2 and 4. Furthermore, if the conveyor 8 is large in comparison to the activation/deactivation field area 16, conventional guide rails (not shown) can be utilized in conjunction with conveyor 8 to guide articles 80 into field area 16.

Figure 6:
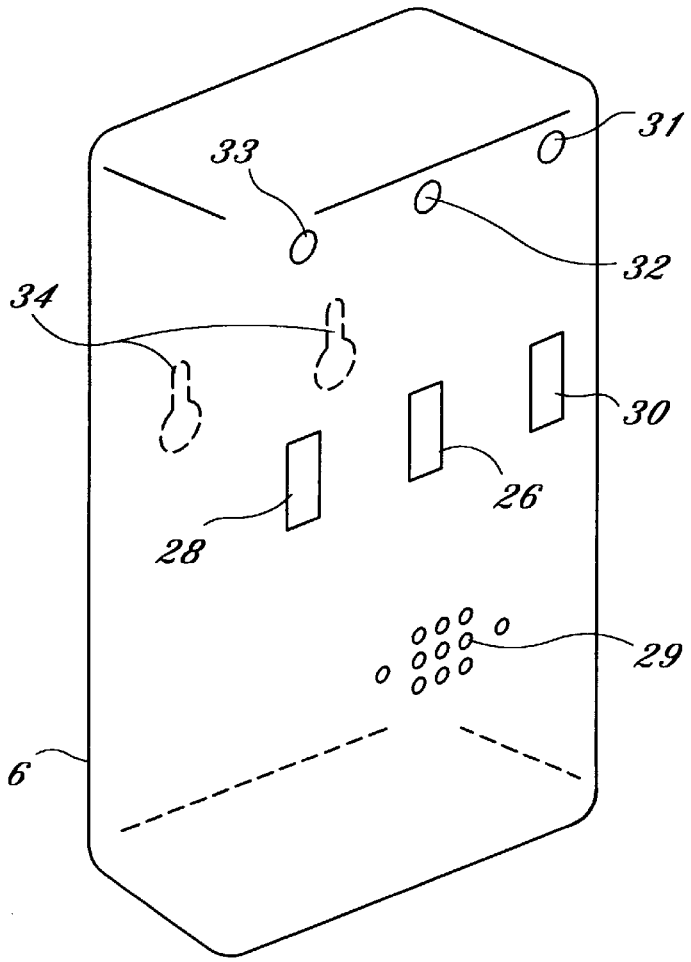
FIG. 6 is a perspective view of the remote external controller of the embodiment of FIG. 1.

For manual operation, remote external controller 6 incorporates remote disabling of the automatic mode and a manual trigger switch. Referring to FIG. 6, one embodiment of remote external controller 6 includes enable/disable switch 26, manual trigger switch 28, audio alarm 29, fault reset switch 30, various status LEDs including fault LED 31, active LED 32, and power LED 33. A suitable mounting arrangement, such as slots 34, can be included for attachment of remote external controller 6 to or near conveyor 8.

As fully described herein below, when enable/disable switch 26 is in the disable position, an article that triggers position indicating sensor 9' will not result in generation or transmission of an activation or deactivation electromagnetic pulse. To generate and transmit an activation or deactivation electromagnetic pulse, manual trigger switch 28 must be manually closed.

Figure 7:
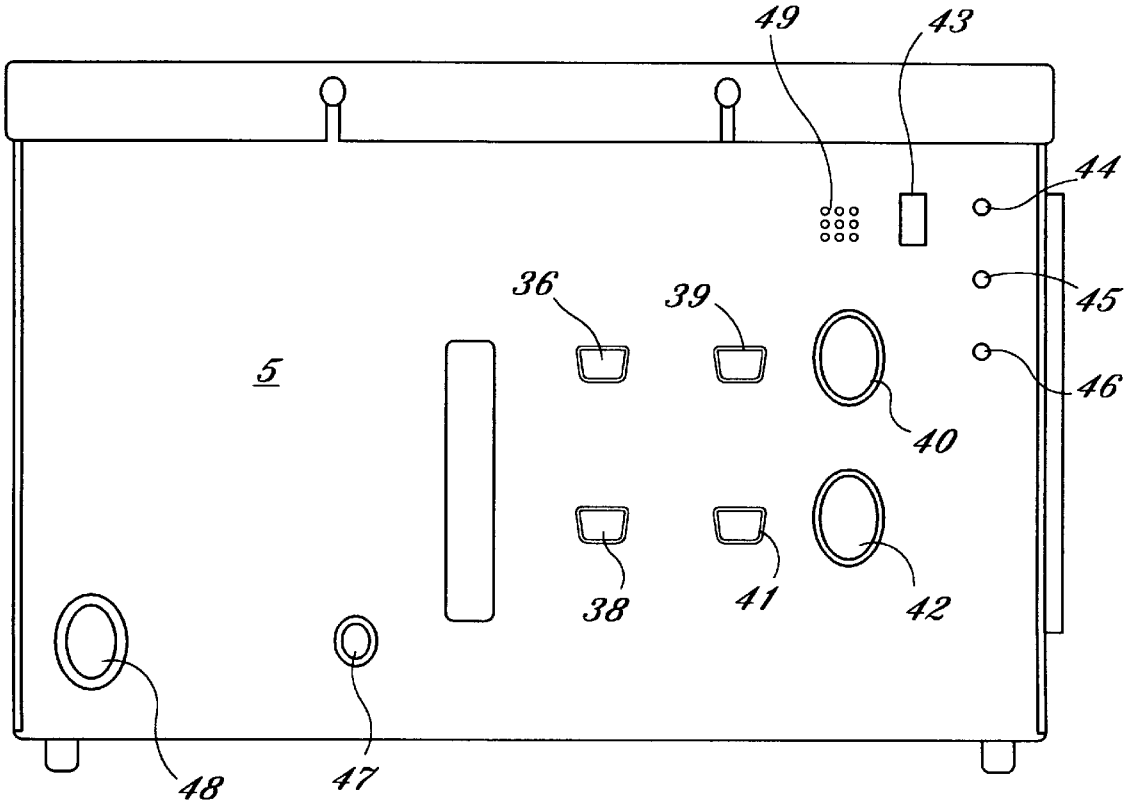
FIG. 7 is a front elevational view of the electronic controller of the embodiment of FIG. 1.

FIG. 7 illustrates one embodiment of the electronic controller 5, which may include remote input jack 36, an external input jack 38, a first position indicating sensor input jack 39, a first electromagnetic coil output jack 40, a second position indicating sensor input jack 41, and a second electromagnetic coil output jack 42. Also included may be reset switch 43, a suitable fuse 47, AC power input jack 48, and audio alarm 49. Status LEDs may include fault LED 44, activity LED 45, and power LED 46.

Status LEDs for fault 44, activity 45, and power 46 indicate a fault condition, sensor housing transmission activity, and "power on" condition, respectively. Similarly, when remote external controller 6 is used, status LEDs on panel 6 for fault 31, active 32, and power 33 indicate a fault condition, sensor housing transmission activity, and "power on" condition, respectively.

Reset 43 on controller 5 and remote reset 30 on remote external controller 6 are used to reset the system after any one of a plurality of fault conditions has been detected and repaired. Fault conditions comprise any of a plurality of errors detected within the system such as over-heating of sensor housings 2 or 4, short circuits, open circuits, power interruption, and the like.

Remote external controller 6 can be interconnected to electronic controller 5 by cable 7 at remote input jack 36, as shown in FIG. 1. Alternately, remote external controller 6 can be interconnected to controller 5 by other conventional links such as radio frequency (RF), infrared (IR), or other equivalent methods (not shown). Sensor housing 2 can be interconnected to controller 5 via cables 3a at position indicating sensor input jack 39 and coil output jack 40. Sensor housing 4 is interconnected via cables 3*b* to housing 5 at position indicating sensor input jack 41 and coil output jack 42.

External input jack 38 provides an input for external inhibit sensor 84. Sensor 84 disables the system and prevents transmission of either an activation or an deactivation pulse. The inhibit sensor 84 can be any conventional sensor that supplies a logic level signal or a relay contact closure. The external inhibit sensor 84 signal is used in the automatic mode to prevent transmission of either an activation or deactivation electromagnetic pulse when an article that is moving along conveyor 8 passes through position indicating sensor 9'.

The external inhibit sensor 84 can be a manual contact closure such as a conventional switch. The manual contact closure switch can be activated by an operator just prior to the article reaching position indicating sensor 9' to prevent an article from being exposed to an activation or deactivation electromagnetic pulse during the automatic mode.

Alternately, the external inhibit sensor 84 can be selected from a plurality of conventional sensors that provide a contact closure or logic level output. The external inhibit sensor 84 can be positioned to sense specific articles by size, or can sense specific indicia on articles just prior to the articles triggering field enable sensor 9'. Indicia may include bar code data 86. The external inhibit sensor 84 automatically sends a contact closure or logic level signal in response to the specific article or indicia 86 and prevents the generation of a activation or deactivation electromagnetic pulse when the article triggers position indicating sensor 9'.

Figure 8:
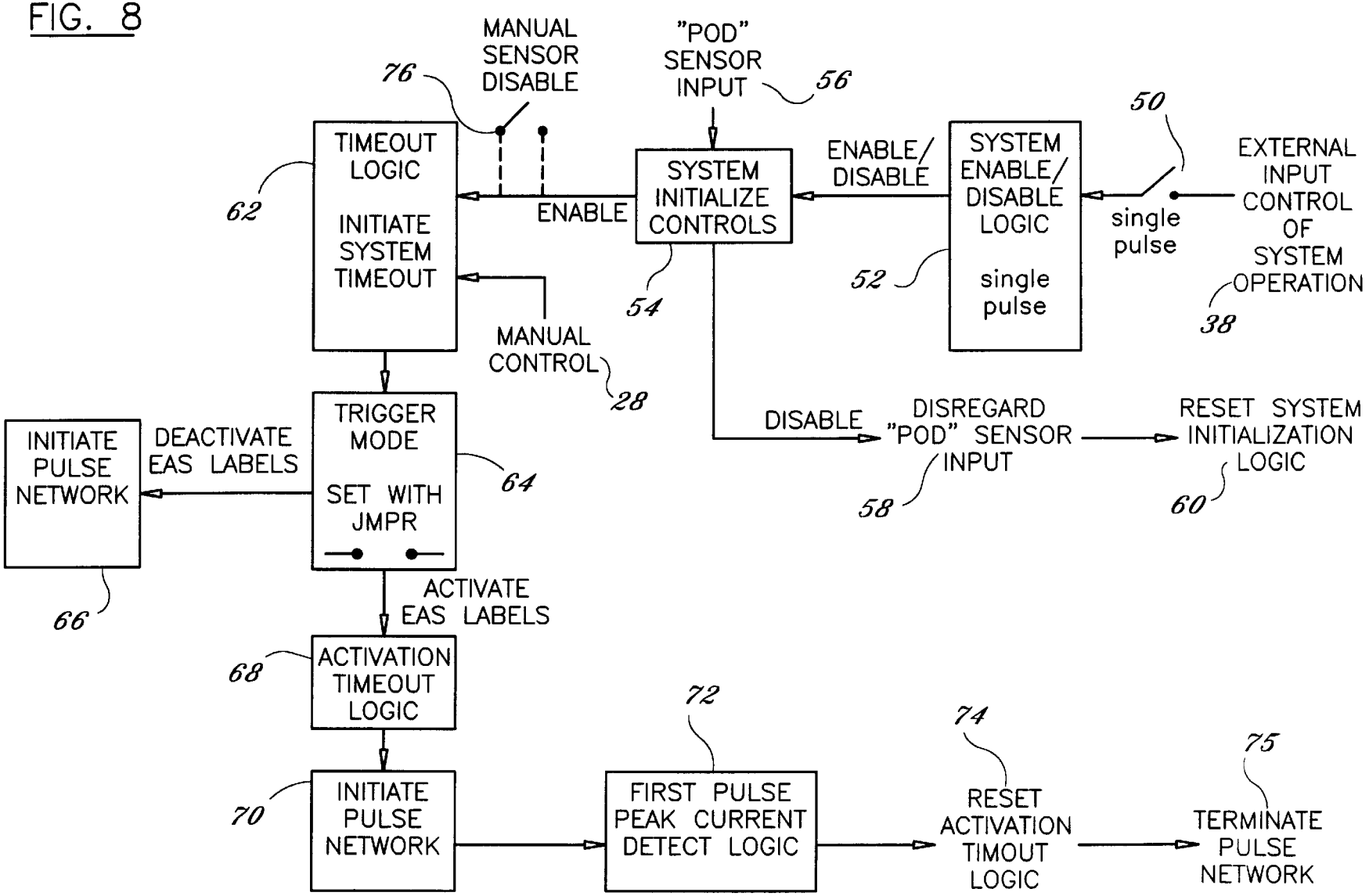
FIG. 8 is a block diagram of the logic control scheme for the invention.

Referring to FIG. 8, the activation/deactivation functional control scheme for operation of the present invention is illustrated, the electronic components of which are mounted in electronic controller 5 on one or more printed circuit boards (PCBs) (not shown). The following is a detailed functional description of controller 5 including the generation of the activation and deactivation electromagnetic fields.

The external input control from external input jack 38, enters system enable/disable control logic 52. The external input control can be a relay contact closure 50, from sensor 84, as described herein. An enable signal is continually sent from system enable/disable control logic 52 to system initialization logic 54 unless a contact closure 50 is detected. If and only if a contact closure 50 is detected at enable/disable logic 52, will a disable signal be sent to initialization logic 54.

If a disable signal is sent from enable/disable logic 52 to initialization logic 54, sensor housing sensor input 56 is disregarded 58 and the system initialization logic 54 is reset 60. Because the system initialization logic 54 is reset 60 after each disable signal from enable/disable logic 52, the next sensor housing sensor input 56 will not be disregarded 58 unless another contact closure 50 is received by enable/disable logic 52. Sensor housing sensor input 56 is received from position indicating sensor 9' when triggered by an article moving into field area 16, as described herein.

If a disable signal is not sent from enable/disable logic 52 to initialization logic 54, then upon receipt of sensor housing sensor input 56 to initialization logic 54, an enable signal is sent from initialization logic 54 to start system timeout logic 62. System timeout logic 62 is preset to prevent the generation and transmission of electromagnetic pulses any faster than once per second. One second is the minimum time that must expire between transmissions of pulses from sensor housings 2 and 4 for the preferred embodiment of the invention as described herein. The selection of once per second is partially dictated by the size of the electromagnetic coils 20 within sensor housings 2 and 4 and the power available within controller 5 for transmission of the electromagnetic pulses.

Once the system timeout logic 62 is enabled or initiated by the system initialization logic 54, the trigger mode logic 64 is enabled. Trigger mode logic 64 determines whether an activation or deactivation pulse should be sent. The choice of activation or deactivation pulses is preset by the user of the system in a manner that makes inadvertent selection difficult. The selection of activation or deactivation electromagnetic pulses is by any suitable manner, and is preferably by installation or removal of a jumper placed directly onto a PCB (not shown) containing electronic components of the system and mounted within the electronic controller 5. If the trigger mode logic 64 senses a jumper setting for a deactivation pulse, pulse network 66 is initiated to generate a deactivation pulse that is transmitted by sensor housings 2 and 4.

Figure 9:
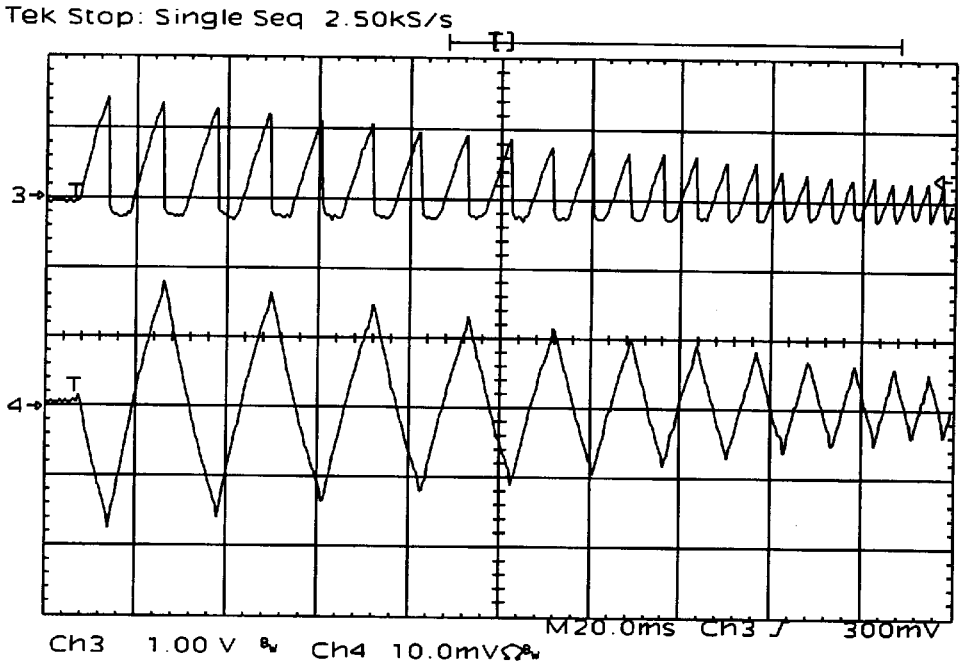
FIG. 9 is a graph showing one embodiment of the deactivation electromagnetic pulse.

FIG. 9 illustrates one embodiment of the deactivation pulse. The graph of FIG. 9 is a copy of an oscilloscope display in which channel 4 represents the current waveform of the deactivation pulse. The pulse is approximately 200 milliseconds (ms) in duration with a decaying "ring-down" amplitude. When transmitted through sensor housings 2 and 4 the deactivation pulse effectively degausses EAS markers 18, of the type herein described as example EAS markers, when placed within the activation/deactivation field area 16 perpendicular to sensor housings 2 and 4. When degaussed, the EAS markers 18 will not resonate at the frequency of interest of the corresponding electronic article surveillance system. Thus, the markers 18 will not trigger the EAS system when brought near the EAS system sensors and are therefore considered deactivated.

Referring again to FIG. 8, if the trigger mode logic 64 senses a jumper setting for an activation pulse, the activation timeout logic 68 is started and pulse network 70 is initiated. Pulse network 70 generates an identical electromagnetic pulse as that generated by pulse network 66 for a deactivation pulse. Peak current detect logic 72 senses the first peak of the pulse generated by pulse network 70, which is identical to the deactivation waveform shown in FIG. 9, and sends a reset 74 to the activation timeout logic 68 and terminates 75 pulse network 70.

Figure 10:
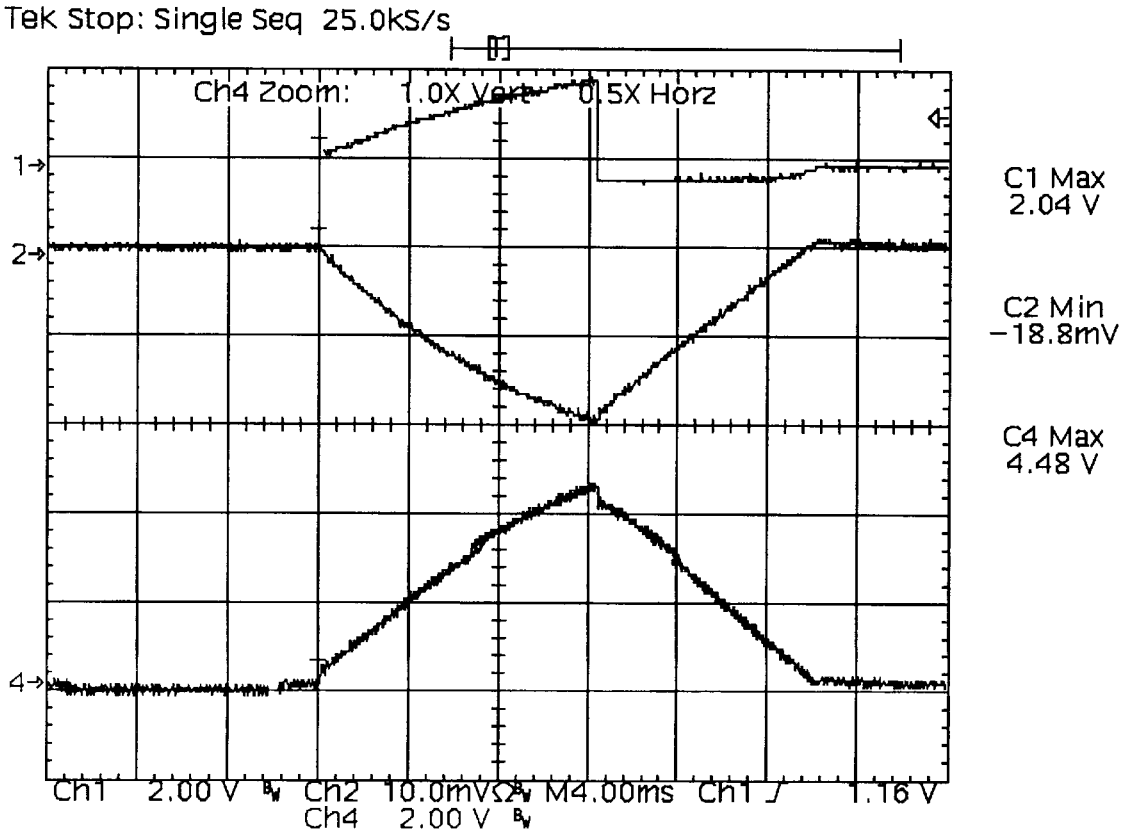
FIG. 10 is a graph showing one embodiment of the activation electromagnetic pulse.

FIG. 10 illustrates the resultant activation pulse that is transmitted by sensor housings 2 and 4. The graph of FIG. 10 is a copy of an oscilloscope display in which channel 2 represents the current waveform of the activation pulse. The activation pulse of FIG. 10 is approximately 20 ms in duration and is identical to the first peak of the deactivation waveform shown in FIG. 9. When transmitted through sensor housings 2 and 4, the activation pulse effectively magnetizes the ferromagnetic element of the EAS markers 18, of the type herein described as example EAS markers, when placed within the activation area 16 perpendicular to sensor housings 2 and 4. When the ferromagnetic element is magnetized, the EAS markers 18 will resonate at the frequency of interest of the corresponding electronic article surveillance system. Thus, the activated markers 18 will trigger the EAS system when brought near the EAS system sensors and the proper personnel can be alerted.

Again referring to FIG. 8, when remote external controller 6 is used with the system for manual operation, the enable/disable switch 26 is placed in the disable position 76. When the enable/disable switch 26 is in the disable position 76, initialization logic 54 will no longer automatically enable the system timeout logic, regardless of sensor housing sensor input 56. To enable system timeout logic 62 and to thus trigger the generation and transmission of an activation or deactivation pulse as described herein above, manual trigger switch 28 must be manually closed. Once a manual trigger 28 signal is sent to enable the system timeout logic 62, the generation and transmission of activation and deactivation pulses is identical to that described herein above for automatic operation.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method for setting the activation state of an electronic article surveillance (EAS) marker associated with an article moving along a conveyor, comprising the steps of:

a) providing an electromagnetic field area in which the article passes through when moving along the conveyor;

b) preselecting an electromagnetic pulse corresponding to the activation state;

c) automatically triggering said preselected electromagnetic pulse only when the article reaches a preselected position within said electromagnetic field area;

d) generating said preselected electromagnetic pulse; and e) transmitting said preselected electromagnetic pulse into said electromagnetic field area and into said EAS marker associated with the article.

2. The method according to claim 1, further including:

f) repeating steps c) through e) at a preselected rate of delivery of articles moving along the conveyor.

3. The method according to claim 2, wherein step c) includes:

sensing when each article reaches a preselected position within said electromagnetic field area; and automatically triggering said preselected electromagnetic pulse.

4. The method according to claim 2, wherein the rate of delivery of articles along the conveyor is approximately one article per second.

5. The method according to claim 1, wherein said preselected electromagnetic pulse is an activation electromagnetic pulse.

6. The method according to claim 1, wherein said preselected electromagnetic pulse is a deactivation electromagnetic pulse.

7. A method for setting the activation state of an electronic article surveillance (EAS) marker associated with an article moving along a conveyor, comprising the steps of:

a) providing an electromagnetic field area disposed so that the article passes through said electromagnetic field area as the article moves along the conveyor;

b) preselecting an electromagnetic pulse corresponding to the activation state;

c) triggering said preselected electromagnetic pulse when said article reaches a preselected position within said electromagnetic field area; wherein step c) includes:

sensing when said article reaches a preselected position within said electromagnetic field area; and, automatic triggering of said preselected electromagnetic pulse;

d) generating said preselected electromagnetic pulse;

e) transmitting said preselected electromagnetic pulse into said electromagnetic field area and into said EAS marker associated with the article;

f) repeating steps c) through e) for a plurality of articles moving along the conveyor;

preselecting an article from the articles moving along the conveyor;

sensing the preselected article just prior to the preselected article reaching said electromagnetic field area; and, inhibiting said automatic triggering of said preselected electromagnetic pulse for the preselected article.

8. The method according to claim 7, wherein the step of inhibiting said automatic triggering includes reading the output of a photo sensor, said photo sensor positioned to sense the preselected article, said preselected article being preselected according to size.

9. The method according to claim 7, wherein the step of inhibiting said automatic triggering includes reading indicia associated with the preselected article, and comparing said indicia with predetermined indicia corresponding to the preselected article that is not to be subjected to said electromagnetic pulse.

10. A system for setting the activation state of an electronic article surveillance (EAS) marker associated with an article moving along a conveyor, comprising:

means for automatically triggering a preselected electromagnetic pulse only when the article reaches a preselected position within an electromagnetic field area;

means for generating said preselected electromagnetic pulse in response to said means for triggering;

means for transmitting said preselected electromagnetic pulse into said electromagnetic field area in response to said means for generating, said electromagnetic field area being defined by said means for transmitting and a portion of the conveyor so the article moving on the conveyor passes through said electromagnetic field area;

wherein said preselected electromagnetic pulse is generated and transmitted to the article when the article is in said preselected position within said electromagnetic field area, and into said EAS marker associated with the article to set the activation state of said marker corresponding to said preselected electromagnetic pulse.

11. The system according to claim 10, wherein said electromagnetic pulse is an activation electromagnetic pulse.

12. The system according to claim 10, wherein said electromagnetic pulse is a deactivation electromagnetic pulse.

13. The system according to claim 10, wherein said electromagnetic pulse is selectable between an activation and a deactivation electromagnetic pulse.

14. The system according to claim 10, wherein a plurality of articles, each having at least one EAS marker attached to or contained within, move along the conveyor at a preselected rate, said means for triggering is automatic and includes means for sensing a preselected position, within said electromagnetic field area, of each of the plurality of articles moving along the conveyor, said means for triggering responsive to said means for sensing.

15. The system according to claim 14, wherein the preselected rate is approximately one article per second.

16. A system for setting the activation state of an electronic article surveillance (EAS) marker associated with an article moving along a conveyor, comprising:

means for automatic triggering of a preselected electromagnetic pulse when the article is in a preselected position within an electromagnetic field area;

means for generating said preselected electromagnetic pulse in response to said means for triggering;

means for transmitting said preselected electromagnetic pulse into said electromagnetic field area in response to said means for generating, said electromagnetic field area being defined by said means for transmitting and a portion of the conveyor so the article moving on the conveyor passes through said electromagnetic field area, said preselected electromagnetic impulse being transmitted into the article when in said preselected position within said electromagnetic field area, and into said EAS marker associated with the article to set the activation state of said marker corresponding to said preselected electromagnetic pulse;

means for sensing a preselected position, within said electromagnetic field area, of each of a plurality of articles moving along the conveyor, said means for triggering responsive to said means for sensing; and, means for remote triggering of said means for generating, said means for remote triggering including means for disabling said automatic means for triggering.

17. A system for setting the activation state of an electronic article surveillance (EAS) marker associated with an article moving along a conveyor, comprising:

means for triggering a preselected electromagnetic pulse when the article is in a preselected position within an electromagnetic field area;

means for generating said preselected electromagnetic pulse in response to said means for triggering;

means for transmitting said preselected electromagetic pulse into said electromagnetic field area in response to said means for generating, said electromagnetic field area being defined by said means for transmitting and a portion of the conveyor so the article moving on the conveyor passes through said electromagnetic field area, said preselected electromagnetic pulse being transmitted into the article when in said preselected position within said electromagnetic field area, and into said EAS marker associated with the article to set the activation state of said marker corresponding to said preselected electromagetic pulse; and, means for inhibiting said means for generating.

18. The system according to claim 17, wherein there are a plurality of articles moving along the conveyor and said means for inhibiting is automatic and responsive to at least one preselected article from the plurality of articles moving along the conveyor.

19. The system according to claim 17, wherein said means for inhibiting said means for generating includes reading indicia associated with a preselected article and comparing said indicia with predetermined indicia corresponding to the preselected article that is not to be subjected to said electromagnetic pulse.

20. An apparatus for setting the activation state of an electronic article surveillance (EAS) marker associated with an article moving along a conveyor, comprising:

a pair of electromagnetic transmitting coils mountable adjacent the conveyor and defining an electromagnetic field area therebetween, wherein the article moving along the conveyor passes through said electromagnetic field area;

a controller having means for generating a preselected electromagnetic pulse;

means for automatically triggering said controller only when the article moving along the conveyor reaches a preselected position within said electromagnetic field area; and, means for transmitting said preselected electromagnetic pulse in response to said means for generating, said means for transmitting electrically connected to said pair of electromagnetic transmitting coils for transmission of said electromagnetic pulse into said electromagnetic field area.

21. The apparatus according to claim 20, wherein said electromagnetic pulse is an activation electromagnetic pulse.

22. The apparatus according to claim 20, wherein said electromagnetic pulse is a deactivation electromagnetic pulse.

23. The apparatus according to claim 20, wherein said electromagnetic pulse is selectable between an activation or deactivation electromagnetic pulse.

24. The apparatus according to claim 20, wherein a plurality of articles move along the conveyor at a preselected rate, said means for triggering includes means for sensing when each of the plurality of articles reach said preselected position within said electromagnetic field area and means, responsive to said means for sensing, for automatically triggering said means for generating.

25. The apparatus according to claim 24, wherein the preselected rate is approximately one article per second.

26. The apparatus according to claim 24, wherein said means for sensing includes at least one photo sensor.

27. An apparatus for setting the activation state of an electronic article surveillance (EAS) marker associated with an article moving alone a conveyor, comprising:

a pair of electromagnetic transmitting coils mountable adjacent the conveyor and defining an electromagnetic field area therebetween, wherein the article moving along the conveyor passes through said electromagnetic field area;

a controller having means for generating a preselected electromagnetic pulse;

means for automatically triggering said controller when the article moving along the conveyor reaches a preselected position within said electromagnetic field area;

means for transmitting said preselected electromagnetic pulse in response to said means for generating, said means for transmitting electrically connected to said pair of electromagnetic transmitting coils for transmission of said electromagnetic pulse into said electromagnetic field area;

means for sensing when each of a plurality of articles reach said preselected position within said electomagnetic field area, said means for automatically triggering responsive to said means for sensing; and, means for inhibiting said means for automatically triggering, said means for inhibiting responsive to an article preselected from the plurality of articles moving along the conveyor.

28. The apparatus according to claim 27, wherein said means for inhibiting includes means for generating a logic level signal.

29. The apparatus according to claim 27, wherein said means for inhibiting said means for automatic triggering includes reading indicia associated with the preselected article and comparing said indicia with predetermined indicia corresponding to the preselected article that is not to be subjected to said electromagnetic pulse.

30. An apparatus for setting the activation state of an electronic article surveillance (EAS) marker associated with an article moving along a conveyor, comprising:

a pair of electromagnetic transmitting coils mountable adjacent the conveyor and defining an electromagnetic field area therebetween, wherein the article moving along the conveyor passes through said electromagnetic field area;

a controller having means for generating a preselected electromagnetic pulse;

means for automatically triggering said controller when the article moving along the conveyor reaches a preselected position within said electromagnetic field area;

means for transmitting said preselected electromagnetic pulse in response to said means for generating, said means for transmitting electrically connected to said pair of electromagnetic transmitting coils for transmission of said electromagnetic pulse into said electromagnetic field area;

means for sensing when each of a plurality of articles reach said preselected position within said electromagnetic field area, said means for automatic triggering responsive to said means for sensing; and, a remote controller, said remote controller including:

means for remote disabling of said means for automatically triggering said means for generating; and, means for manually triggering said means for generating.

* * * * *

UNITED STATES PATENT AND TRADEMARK OFFICE

CERTIFICATE OF CORRECTION

PATENT NO : 5,973,606

DATED : October 26, 1999

INVENTOR(S) : Maitin, et al

It is certified that error appears in the above-identified patent and that said Letters Patent is hereby corrected as shown below:

Column 12, line 52, change "impulse" to --pulse--.

Signed and Sealed this

Twenty-fifth Day of July, 2000

*Attest:*

Q. TODD DICKINSON

*Attesting Officer*

*Director of Patents and Trademarks*